US010535448B2

(12) United States Patent
Henriksen et al.

(10) Patent No.: US 10,535,448 B2
(45) Date of Patent: Jan. 14, 2020

(54) STAINLESS STEEL SCREEN AND NON-INSULATING JACKET ARRANGEMENT FOR POWER CABLES

(71) Applicant: NEXANS, Courbevoie (FR)

(72) Inventors: Martin Henriksen, Lyons (FR); David Dubois, Clerques (FR)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 15/850,685

(22) Filed: Dec. 21, 2017

(65) Prior Publication Data

US 2019/0198197 A1 Jun. 27, 2019

(51) Int. Cl.
*H01B 9/02* (2006.01)

(52) U.S. Cl.
CPC ..... *H01B 9/02* (2013.01); *H01B 9/027* (2013.01)

(58) Field of Classification Search
CPC ... H01B 1/02; H01B 1/04; H01B 7/02; H01B 7/04; H01B 9/02; H01B 9/027
USPC ..... 174/102 R, 103, 105, 106 R, 108, 109, 174/110 R, 110 SC, 120 R, 120 SC
See application file for complete search history.

(56) References Cited

U.S. PATENT DOCUMENTS

| | | | | | |
|---|---|---|---|---|---|
| 3,707,595 | A * | 12/1972 | Plate | H01B 9/02 | 174/105 SC |
| 3,792,192 | A * | 2/1974 | Plate | H01B 7/0275 | 174/102 SC |
| 3,795,540 | A * | 3/1974 | Mildner | H01B 3/441 | 428/215 |
| RE30,228 | E * | 3/1980 | Silver | H01B 9/022 | 156/54 |
| 4,986,372 | A | 1/1991 | Ganssle | | |
| 6,284,832 | B1 * | 9/2001 | Foulger | C08L 23/06 | 252/502 |
| 6,506,492 | B1 * | 1/2003 | Foulger | H01B 1/22 | 174/110 PM |
| 2008/0190643 | A1 | 8/2008 | Lumachi et al. | | |
| 2012/0205137 | A1 * | 8/2012 | Fjellner | F16L 11/22 | 174/116 |
| 2016/0141076 | A1 | 5/2016 | Perego et al. | | |

FOREIGN PATENT DOCUMENTS

| | | | | |
|---|---|---|---|---|
| CN | 106 531 331 | | 3/2017 | |
| JP | H64-12409 A | * | 1/1989 | H01B 7/17 |
| JP | 11-273466 A | * | 10/1999 | H01B 9/00 |

OTHER PUBLICATIONS

European Search Report dated May 6, 2019.

* cited by examiner

*Primary Examiner* — William H. Mayo, III
(74) *Attorney, Agent, or Firm* — Sofer & Haroun, LLP

(57) ABSTRACT

A cable including a conductor. An insulation system surrounds the conductor. A metallic screen surrounds the insulation system. A jacket surrounds the insulation system. The metallic screen is constructed of stainless steel.

6 Claims, 5 Drawing Sheets

STAINLESS STEEL SCREEN AND NON-INSULATING JACKET ARRANGEMENT FOR POWER CABLES

FIELD OF THE INVENTION

The present application relates to power cables. More particularly, the present application relates to improved screens and jackets for use in high voltage cables that improve electrical performance by reducing losses caused for example by induced currents in the screen and/or jacket.

DESCRIPTION OF THE RELATED ART

A common type of underground high voltage cable, shown for example in FIG. 1, includes a core having a conductor 1000 surrounded by a three part insulation system (semiconductor 1002/insulator 1004/semiconductor 1006). The three part insulation system is covered by a metallic screen 1008 and then the entire cable is covered by an outer protective jacket 1010.

Between outer jacket 1010 and outside layer 1006 of the three-part insulation system, metal screen 1008 functions as a barrier layer providing a screen effect for discharging short circuits as well as a water/moisture barrier. The presence of metallic screen 1008 is necessary to establish an effective radial barrier against moisture diffusion through polymer jacket 1010 into the underlying solid dielectric insulation, which can lead to degradation (e.g. water treeing) of insulation system.

However, this metal screen 1008 can have an impact on the electrical characteristics of the cable. For example, high voltage cables with such metallic screens 1008 can experience induced current in the screen (a conductor) resulting in joule losses escaping into metallic screen 1008 and also outer jacket 1010. The joule losses are current dependent and can be divided in two categories: losses from circulating screen currents in the case where the screens are grounded, and eddy current losses.

Induced voltages in the cable screens can be caused by current flow in the conductor. That induced voltage can cause a circulating current to flow if the cable is earthed at both ends. That circulating current can be high, causing localized heating at ferromagnetic gland plates, any associated tray work, metallic trunking, conduit etc. . . . These circulating currents also generate eddy currents at the gland plates etc that create further heating effects.

For example, cable designs with an insulating jacket 1010 over a metallic screen 1008 result in induced voltage in the metallic screen 1008 and jacket 1010 that accumulates over the length of the cable unless metallic screen 1008 and jacket 1010 have been bonded to ground at both ends. However, when grounded at both ends, the induced voltage (per length of the cable) creates circulating currents in screen 1008 as well as jacket 1010 increasing the electrical losses in cable conductor 1000.

In current prior art solutions metallic screen 1008 is typically made of either aluminum or copper, both of which are lightweight and provide acceptable protections from the environment. However, these solutions are very conductive and, owing to the proximity to the high voltage central conductor in the core, they can cause induced circulating screen currents and eddy current losses as explained above, reducing the overall electrical performance of the cable.

Another prior art solution is to extrude screen 1008 as a lead barrier between outer jacket 110 and primary conductor insulation 1006. The lead is not very conductive, but is, even at the thinnest possible arrangement for lead, still relatively thick compared to other metal screens and is also very heavy, both of which are not generally considered to be desirable features in cable design.

A related issue with high voltage cables as shown in FIG. 1 (e.g. core with a conductor and surrounding three part insulation system (semiconductor 1002/insulator 1004/semiconductor/1006)), is that when core 1000 is covered by metallic screen 1008 and then outer jacket 1010, in addition to the issues caused by metallic screen 1008 noted above, the jacket itself also causes inductive/dielectric losses over the length of the cable which can be significant in high voltage cables. For example dielectric loss is caused by a dielectric material's (insulative jacket 1010) inherent dissipation of electromagnetic energy, realized as heat.

For example, currently jackets 1010 of such high voltage cables are made of suitable polymers for high voltage underground applications such as polyethylene, polyamides, and polyesters. However, as noted above when jacket 1010 and screen 1008 are grounded at both ends, the induced voltage creates circulating currents in screen 1008. These currents can also circulate in the dielectric jacket 1010 increasing the electrical loss in the cable.

In another case where metallic screen 1008 and/or jacket 1010 is not grounded at both ends, the accumulation of induced voltage in metallic screen 1008 may result in a need for an insulating jacket 1010 that can withstand the voltage that has been induced in metallic screen 1008 under all such conditions. In other words, with grounding, jacket 1010 can be thinner but screen 1008 and jacket 1010 can both induce losses via circulating currents. If jacket 1010 and screen 1008 are not grounded, this problem is avoided by making jacket 1010 thicker, but jacket 1010 would then need to be very thick to withstand very high voltages, for example during a short event, and such thick jackets 1010 are generally undesirable because of cost, weight, flexibility etc. . . .

Also without a grounded arrangement there may be a need for protecting screen 1008 and jacket 1010 against interruption during voltage surges by means of sheath voltage limiters (SVL's). Because the sheath of a cable is in such close proximity to the conductor, the voltage appearing on an open sheath can be substantial and is directly related to the current flowing through the phase conductor. This relationship applies during steady state as well as during faults. A sheath voltage limiter (SVL) is basically a surge arrester. The main purpose of the sheath voltage limiter is to clamp or limit the voltage stress across the cable jacket. Although SVL work, they add cost to the cable design/implementation.

Another issue with insulating jackets on high voltage cables is that there can be local discharges of the induced currents between metallic screen 1008 and the ground through portions of jacket 1010 that may have been previously locally weakened (e.g. during cable pulling). This localized leak current from metallic screen 1008 into the ground through the weakened portions of jacket 1010 can cause possible local thermal deterioration of cable and jacket 1010 or corrosion of metallic screen 1008 at those locations.

In addition, in case of metallic screens 1008 made with a high resistance (like lead) or highly insulative jackets 1010, the effect on the cable's charging current may make it difficult to control voltage over the line or otherwise be a detriment to the use of such cables. Charging currents in transmission lines are due to the capacitive effect between the conductors of the line and the ground. The inductance and capacitance that are responsible for this phenomenon is related to the materials used for the cable components and such highly resistive shields 1008 coupled with insulative jackets 1010 contribute to this effect. In underground cables where the cables are very close to the ground, possibly as close as a few inches, the charging currents that would result from long spans of high voltage cables can prevent their use.

OBJECTS AND SUMMARY

To this end, the present arrangement provides an underground high voltage cable with lower induction caused by losses from the screen. In one embodiment, a single phase high voltage cable may have its core covered by a thin (e.g. <0.5 mm) laminate of stainless steel (non-corrugated), that may be firmly bonded to either the cable core (outside layer of semiconductor in the three part insulation) or to the inside of the cable jacket.

The present arrangement also may provide an underground high voltage cable with lower induction losses caused by the jacket. In one embodiment, a single phase high voltage cable with a core and metallic screen may be covered in a jacket material (e.g. Polyethylene, Polyamide, Polyester) that additionally includes a conductive component such as carbon black therein. The extruded jacket is firmly bonded to the metallic screen.

Such embodiments of the stainless steel screen layer and the non-insulating semi-conductive outer jacket may be combined with one another in a single high voltage cable or may be independently applied to prior art cables (such as stainless steel screen with a non-conducting jacket or a semi-conducting jacket with a copper screen).

BRIEF DESCRIPTION OF THE DRAWINGS

The present invention can be best understood through the following description and accompanying drawings, wherein.

DETAILED DESCRIPTION

Figure 1:
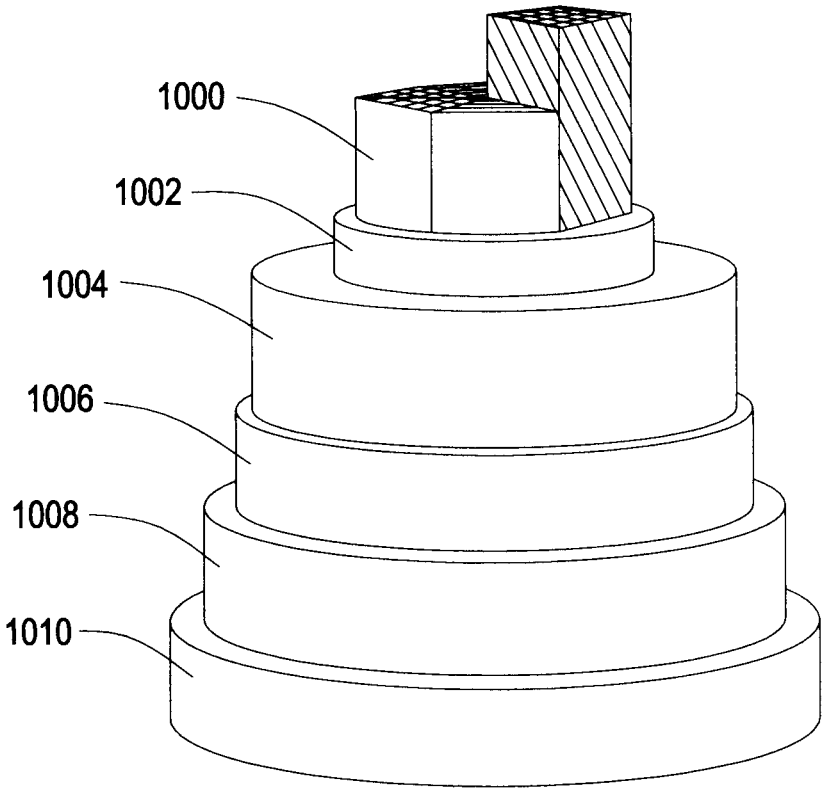
FIG. 1 (PRIOR ART)
FIG. 1 is a prior art underground electric cable according to the prior art.
Figure 2:
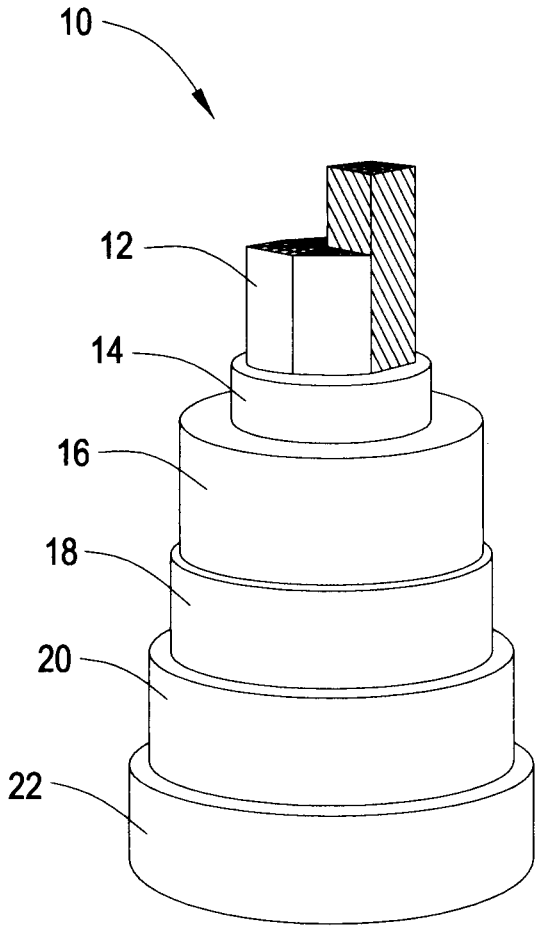
FIG. 2 is an underground electric cable according to one embodiment.

In one embodiment of the present arrangement as shown in FIG. 1, an underground electric cable 10 has a primary conductor 12 surrounded by a three part insulation system of a semiconductor layer 14, an insulator layer 16 and a semiconductor layer 18. This three part insulation system 14/16/18 is covered by a metallic screen 20 and cable 10 is finally surrounded by a jacket 22.

Unlike the prior art, metallic screen 20 is a preferably (<0.5 mm) laminate of stainless steel, preferably without corrugation, firmly bonded to either an outside surface of cable core (semiconductor layer 18) or to an inside surface of cable jacket 22. The low conductivity of stainless steel laminate screen 20 reduces the losses from circulating current and eddy currents in the metallic sheath of the individual cable cores owing to its lower conductivity relative to prior art screens. The preferably non-corrugated application of the laminate screen 20 allows for a reduction of the odiameter of cable 10. The firm bonding of screen/laminate 20 to either jacket 22 or semiconductor layer 18 allows for improved bending tolerances for cable 10 and likewise prevents wrinkling of screen 20 as the bonded elements will move together and not move (abrasion) relative to one another.

Figure 3:
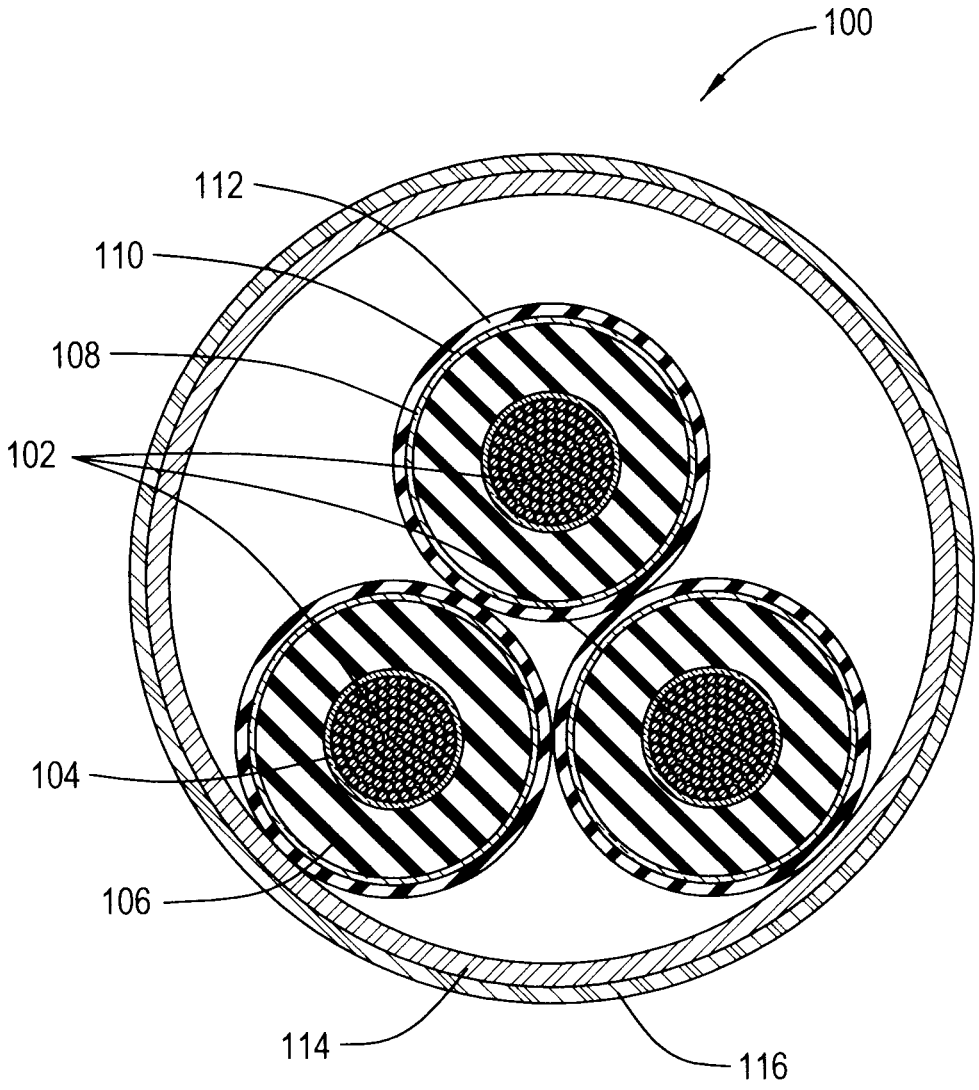
FIG. 3 is a multi-phase underground electric cable according to the embodiment of FIG. 2.

In an alternative embodiment, shown in FIG. 3, a three phase cable 100 is shown. Cable 100 has three cores each having conductors 102, semiconductor layers 104, insulation 106, and semiconductor layer 108. As with cable 10, in cable 100, each of the cores has a metallic screen 110 and jacket 112. The metallic screen 110 is a preferably (<0.5 mm) laminate of stainless steel preferably without corrugation, firmly bonded to either the outside of semiconductor layer 108 or to the inside of cable jacket 112. Outside of the cores, the three phases are surrounded by a steel pipe 114 with a polymer coating 116.

Figure 4:
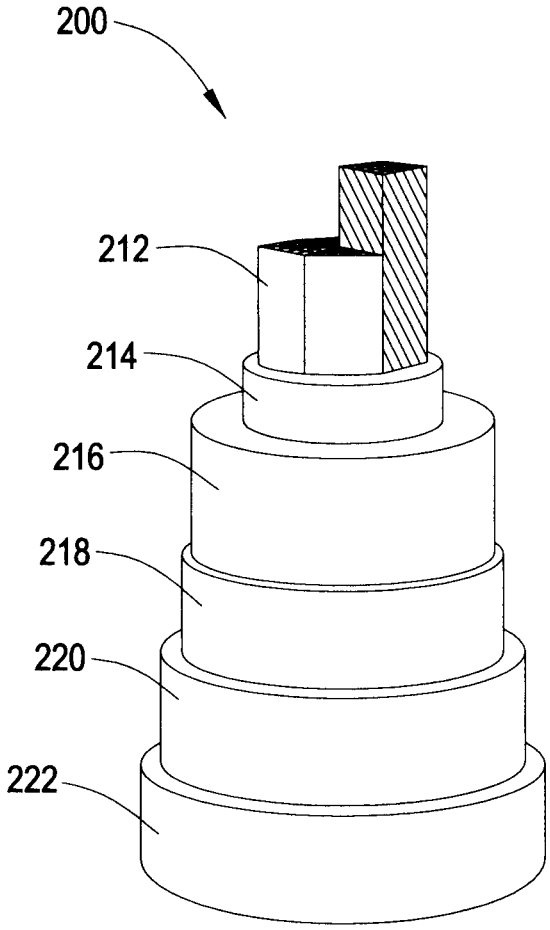
FIG. 4 is an underground electric cable according to one embodiment.

FIG. 4 shows another embodiment of the present arrangement for a cable 200 with a non-insulating outer jacket 222. This arrangement can be used in conjunction with prior art structures (having copper/aluminum sheaths) as well as with cable design implementing the stainless steel screen 20/110 described above.

In FIG. 4, an underground electric cable 200 has a primary conductor 212 surrounded by a three part insulation system of a semiconductor layer 214, an insulator layer 216 and a semiconductor layer 218. This three part insulation system 214/216/218 is covered by a metallic screen 220, with all of the components of cable 200 being surrounded by a jacket 222.

Unlike the prior art jackets, jacket 222 is preferably made from Poly Ethylene, Poly Amide, Poly Esther with included conductive charge carrying particles (Carbon Black). Jacket 222 may be extruded onto and firmly bonded to metallic screen 218 (lead, copper laminate, aluminum laminate or steel laminate). The amount of conductivity (i.e. carbon black density) added to non-insulating jacket 222 is sufficient to control sheath voltage by reducing the accumulation of induced sheath voltage, but simultaneously not conductive enough to allow for its own significant circulating currents.

Figure 5:
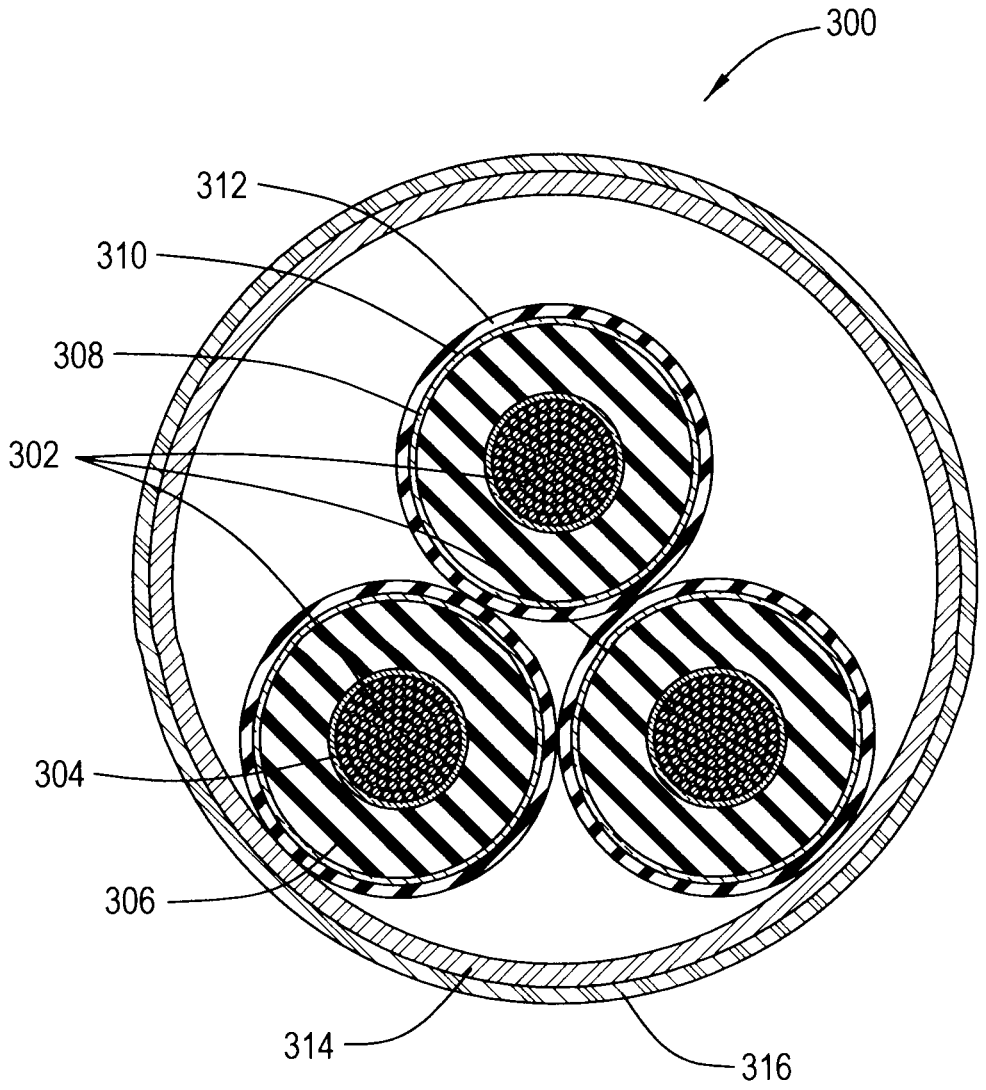
FIG. 5 is a multi-phase underground electric cable according to the embodiment of FIG. 4.

In an alternative embodiment, shown in FIG. 5, a three phase cable 300 is shown. Cable 300 has three cores each having conductors 302, semiconductor layers 304, insulation 306, and semiconductor layer 308. As with cable 200, each of the cores of cable 300 has a metallic screen 310 and jacket 312. The metallic screen 310 is a preferably (<0.5 mm) laminate of stainless steel preferably without corrugation, firmly bonded to either the outer surface of semiconductor layer 308 or to the inner surface of cable jacket 312. Metallic screen 310 could otherwise be a copper or aluminum screen (prior art), but ideally is made of stainless steel. The jackets 312 are made from Poly Ethylene, Poly Amide, Poly Esther) with included conductive charge caring particles (Carbon Black) are applied by extrusion onto and is firmly bonded to the metallic screen 310, with an amount of conductivity sufficient to reduce the accumulation of induced sheath voltage, but simultaneously not conductive enough to allow for its own significant circulating currents. Outside of the cores, the three phases are surrounded by a steel pipe 314 with a polymer coating 316.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A cable comprising:

a conductor;

an insulation system directly surrounding the conductor, wherein the insulation system is a three part insulation system that includes a semi-conductive polymer layer surrounded by an insulative polymer layer surrounded by a semi-conductive polymer layer;

a metallic screen directly surrounding, and in contact with, the insulation system; and a conductive jacket surrounding the metallic screen, wherein said metallic screen is constructed of non-corrugated stainless steel, and wherein said conductive jacket includes sufficient carbon black density added to control sheath voltage by reducing the accumulation of induced sheath voltage, but simultaneously does not include sufficient carbon black density that would allow accumulation of circulating currents.

2. The cable as claimed in claim 1, wherein the metallic screen is bonded to either one of an outside surface of the insulation system or an inside surface of said jacket.

3. The cable as claimed in claim 1, wherein said metallic screen is less than 0.5 mm thick.

4. A cable comprising:

a conductor;

an insulation system directly surrounding the conductor, wherein the insulation system is a three part insulation system that includes a semi-conductive polymer layer surrounded by an insulative polymer layer surrounded by a semi-conductive polymer layer;

a stainless steel non-corrugated metallic screen directly surrounding, and in contact with, the insulation system; and a conductive jacket surrounding the metallic screen, wherein said jacket includes conductive particles, and wherein said conductive jacket includes sufficient carbon black density added to control sheath voltage by reducing the accumulation of induced sheath voltage, but simultaneously does not include sufficient carbon black density that would allow accumulation of circulating currents.

5. The cable as claimed in claim 4, wherein the metallic screen is bonded to either one of an outside surface of the insulation system or an inside surface of said jacket.

6. The cable as claimed in claim 4, wherein said metallic screen is less than 0.5 mm thick.

* * * * *